US007410940B2

(12) United States Patent
Hüglin et al.

(10) Patent No.: US 7,410,940 B2
(45) Date of Patent: Aug. 12, 2008

(54) ANTIOXIDANTS FOR THE STABILIZATION OF SURFACTANT FORMULATIONS

(75) Inventors: Dietmar Hüglin, Eimeldingen (DE); Erich Kramer, Basel (CH)

(73) Assignee: Ciba Specialty Chemicals Corp., Tarrytown, NY (US)

( * ) Notice: Subject to any disclaimer, the term of this patent is extended or adjusted under 35 U.S.C. 154(b) by 0 days.

(21) Appl. No.: 11/977,633

(22) Filed: Oct. 25, 2007

(65) Prior Publication Data

US 2008/0108540 A1 May 8, 2008

Related U.S. Application Data

(60) Division of application No. 10/323,123, filed on Dec. 18, 2002, now abandoned, which is a continuation of application No. 09/734,234, filed on Dec. 7, 2000, now abandoned, which is a continuation of application No. 09/298,571, filed on Apr. 23, 1999, now abandoned.

(30) Foreign Application Priority Data

Apr. 28, 1998 (EP) ..... 98810374
Oct. 23, 1998 (CH) ..... 2143/98

(51) Int. Cl.
*C11D 3/20* (2006.01)

(52) U.S. Cl. ..... 510/505

(58) Field of Classification Search ..... 510/505
See application file for complete search history.

(56) References Cited

U.S. PATENT DOCUMENTS

| | | | | |
|---|---|---|---|---|
| 3,356,612 | A | 12/1967 | Guthrie | 252/99 |
| 3,369,304 | A | 2/1968 | Clark et al. | 34/9 |
| 3,436,351 | A | 4/1969 | Doan et al. | 252/137 |
| 3,657,322 | A | 4/1972 | Dexter et al. | 260/473 |
| 4,201,803 | A | 5/1980 | DePaolo | 427/381 |
| 4,853,143 | A | 8/1989 | Hardy et al. | 252/102 |
| 4,900,469 | A | 2/1990 | Farr et al. | 252/96 |
| 5,712,237 | A | 1/1998 | Stevens | 510/291 |
| 5,843,876 | A | 12/1998 | Payne | |
| 5,994,286 | A | 11/1999 | Desai et al. | 510/386 |

FOREIGN PATENT DOCUMENTS

| | | |
|---|---|---|
| GB | 2257141 | 1/1993 |
| WO | 96/03481 | 2/1996 |
| WO | 97/27839 | 8/1997 |
| WO | 99/05250 | 2/1999 |

OTHER PUBLICATIONS

Derwent Abstr. 93-402031 for KR 9303761 (1993).
Derwent Abstr. 91-308256 for SU 1604839 (1990).
G. P. Filinov et al., Kauchuk I Rzina, vol. 31 (3), pp. 15-16, (1972), No month available. English abstract only.

*Primary Examiner*—John R Hardee
(74) *Attorney, Agent, or Firm*—Mervin G. Wood

(57) ABSTRACT

The invention relates to cleaning compositions comprising
($a_1$) a phenolic antioxidant of the formula (1) and/or (2); and/or
($a_2$) an antioxidant of the formula (3); and
(b) a surfactant comprising a long alkyl or alkenyl chain.
The antioxidants used according to the invention have excellent reactivity, good stability to hydrolysis, particularly in an alkaline medium, and, because of their solubility, can be easily incorporated into the soap formulations.

11 Claims, No Drawings

ANTIOXIDANTS FOR THE STABILIZATION OF SURFACTANT FORMULATIONS

This application is a divisional of application Ser. No. 10/323,123, filed on Dec. 18, 2002, now abandoned, which is a continuation of application Ser. No. 09/734,234, filed on Dec. 7, 2000, now abandoned, which is a continuation of application Ser. No. 09/298,571, filed on Apr. 23, 1999, now abandoned, the contents all of which are hereby incorporated by reference.

Solid and liquid soaps have been used for cleaning human skin for a long time. The stability of the soap composition is an important criterion for problem-free use or a long shelf life.

It is known that free radical reactions adversely affect the stability of a soap composition. Free radicals initiate chain reactions which effect the decomposition of the long-chain hydrocarbon chains of the soaps, free acids or synthetic surfactants and the like in cleaning compositions. Such reactions can also bring about other negative effects, such as, for example, discoloration and rancidification.

Degradation of the long hydrocarbon chains can be prevented in cleaning compositions by adding antioxidants, such as, for example, butylated hydroxytoluene (BHT), which either prevent the catalysis of certain free radical mechanisms or, as free radicals, terminate the free radical chain reaction.

However, the use of BHT causes stability problems in the soap compositions, such as, for example, decoloration, or yellow-brown by-products form.

WO 97/27839 discloses soap compositions in which the stabilizers used are specific phenolic antioxidants. However, these compounds have poor solubility and can only be incorporated with difficulty.

The object of the invention was thus to find phenolic antioxidants which have better solubility in soap formulations and can be incorporated without problem into the corresponding soap compositions.

The present invention thus provides a cleaning composition comprising ($a_1$) a phenolic antioxidant of the formula (1)

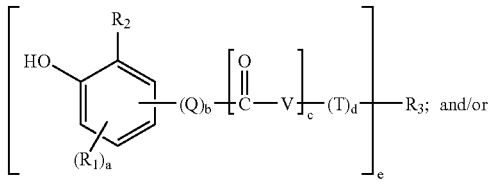

(2)

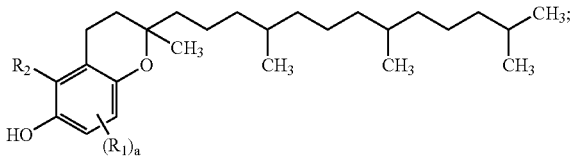

and/or ($a_2$) an antioxidant of the formula (3)

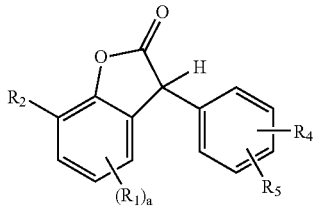

in which in the formulae (1), (2) and (3)

$R_1$ is hydrogen; $C_1$-$C_{22}$ alkyl; $C_1$-$C_{22}$ alkylthio; $C_5$-$C_{12}$ cycloalkyl; phenyl; or $C_7$-$C_9$ phenylalkyl;

$R_2$ is $C_1$-$C_{22}$ alkyl; $C_5$-$C_{12}$ cycloalkyl; phenyl; $C_7$-$C_9$ phenylalkyl; or —$SO_3M$;

Q is —$C_mH_{2m}$—;

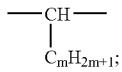

—$C_mH_{2m}$—NH; a radical of the formula (1a)

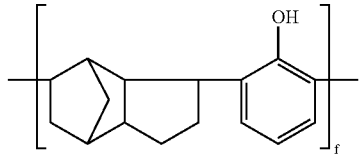

; or (1b)

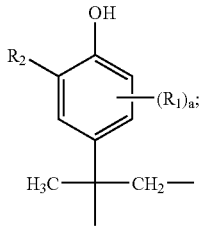

T is —$C_nH_{2n}$—; —$(CH_2)_n$—O—$CH_2$—;

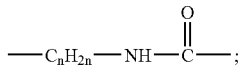

or a radical of the formula (1c)

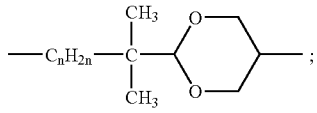

V is —O—; or —NH—;

a is 0; 1; or 2;

b, c and d independently of one another are 0; or 1;

e and f independently of one another are an integer from 1 to 3; and m, n and p independently of one another are an integer from 1 to 3;

when e is 1, $R_3$ is hydrogen; M; $C_1$-$C_{22}$ alkyl; $C_5$-$C_{12}$ cycloalkyl; $C_1$-$C_{22}$ alkylthio; $C_2$-$C_{22}$ alkenyl; $C_1$-$C_{18}$ phenylalkyl; a radical of the formula (1d)

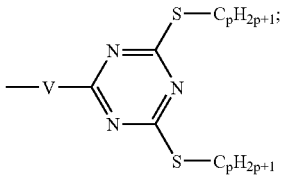

(1e)

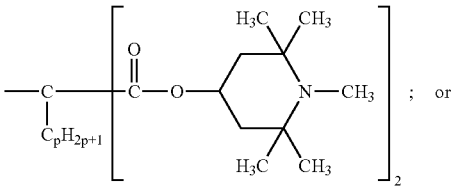

(1f)

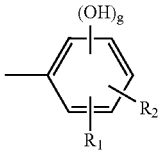

where, when $R_3$ is $C_1$-$C_{22}$ alkyl, b=0; or Q is a radical of the formula (1a) or (1b);

g is 0 or 1;

M is alkali metal; ammonium;

when e is 2, $R_3$ is a direct bond; —$CH_2$—;

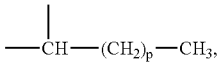

—O—; or —S—;

when e is 3, $R_3$ is a radical of the formula (1g)

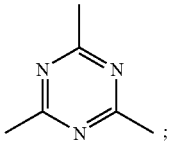

(1h)

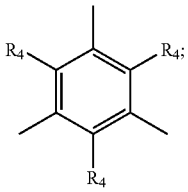

-continued (1i)

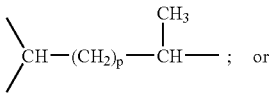

(1k)

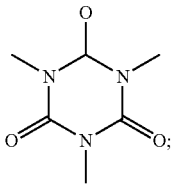

where, when $R_3$ is a radical of the formula (1k), c=1; and;

$R_4$ and $R_5$ independently of one another are hydrogen; or $C_1$-$C_{22}$ alkyl; and (b) a surfactant comprising a long alkyl or alkenyl chain.

$C_1$-$C_{22}$-Alkyl are straight-chain or branched alkyl radicals, such as, for example, methyl, ethyl, n-propyl, isopropyl, n-butyl, sec-butyl, tert-butyl, amyl, isoamyl or tert-amyl, heptyl, octyl, isooctyl, nonyl, decyl, undecyl, dodecyl, tetradecyl, pentadecyl, hexadecyl, heptadecyl, octadecyl or eicosyl.

$C_1$-$C_{22}$-Alkylthio are straight-chain or branched alkylthio radicals, such as, for example, methylthio, ethylthio, n-propylthio, isopropylthio, n-butylthio, sec-butylthio, tert-butylthio, amylthio, heptylthio, octylthio, isooctylthio, nonylthio, decylthio, undecylthio, dodecylthio, tetradecylthio, pentadecylthio, hexadecylthio, heptadecylthio, octadecylthio or eicosylthio.

$C_2$-$C_{18}$-Alkenyl is, for examply, allyl, methallyl, isopropenyl, 2-butenyl, 3-butenyl, isobutenyl, n-penta-2,4-dienyl, 3-methyl-but-2-enyl, n-oct-2-enyl, n-dodec-2-enyl, isododecenyl, n-dodec-2-enyl or n-octadec-4-enyl.

$C_5$-$C_7$-Cycloalkyl is cyclopentyl, cycloheptyl or, in particular, cyclohexyl.

$C_7$-$C_9$-Phenylalkyl is phenylpropyl, phenylethyl and, in particular, benzyl.

In the novel composition, preference is given to using antioxidants of the formula (1) in which Q is —$C_mH_{2m}$—, and in particular a methylene or ethylene radical and m is as defined in formula (1).

In particular, V in formula (1) is —O—.

Of particular interest in the novel composition are compounds of the formula (1) in which $R_1$ and $R_2$ independently of one another are $C_1$-$C_{22}$ alkyl, and in particular $C_1$-$C_5$ alkyl.

Furthermore, there is also particular interest in compounds of the formula (1) in which a is 1.

Of very particular interest are compounds of the formula (2)

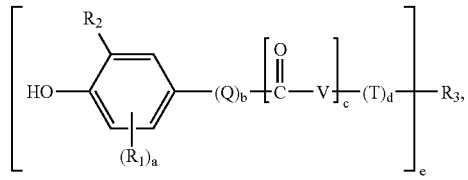

in which $R_1$ and $R_2$ independently of one another are $C_1$-$C_5$ alkyl, a is 1 or 2; and $R_3$, Q, V, T, b, c, d and e are as defined in formula (1).

Particular preference is given to compounds of the formula (2) in which e is 1.

Compounds of particular interest are those of the formula (3)

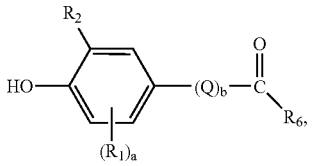

in which $R_6$ is —O—M; or

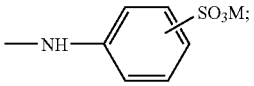

M is hydrogen; ammonium; or alkali metal; and $R_1$, $R_2$, Q, a and b are as defined in claim 8.

Furthermore, component ($a_1$) is preferably a compound of the formula (4)

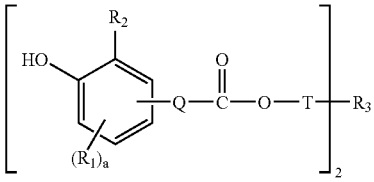

in which $R_1$ and $R_2$ independently of one another are $C_1$-$C_5$ alkyl;

Q is $—C_mH_{2m}—$; or $—C_mH_{2m}—NH—$;

$R_3$ is a direct bond; —O—; or —S—;

a is 1 or 2;

m is 1 to 5; and

T is as defined in formula (1).

Of the compounds of the formula (3), preference is given to those in which

Q is ethylene;

$R_3$ is a direct bond; and $R_1$, $R_2$, T and a are as defined in formula (3).

Very particularly preferred compounds of the formula (4) are those in which

T is $—O—CH_2$.

Other interesting compounds which can be used according to the invention conform to the formula (5)

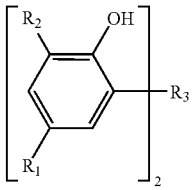

in which $R_1$ and $R_2$ are $C_1$-$C_5$-alkyl; and $R_3$ is $—CH_2—$ or —CH— or

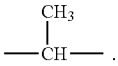

Of the compounds of the formula (2) to (5), preference is given to those in which $R_1$ and $R_2$ are the tert-butyl radical; and a is 1.

Furthermore, in the novel formulation, component ($a_1$) is preferably a compound of the formula (6)

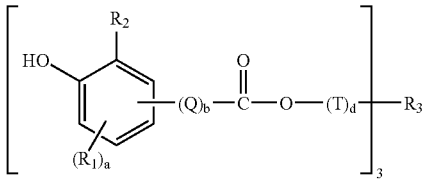

in which

Q is $—C_mH_{2m}—$;

T is $—C_nH_{2n}—$;

$R_1$ and $R_2$ independently of one another are $C_1$-$C_5$ alkyl;

$R_3$ is the radical of the formula (1g); (1h); (1i); or (1k);

m and n independently of one another are from 1 to 3;

a is 1 or 2; and b and d independently of one another are 0 or 1;

and very particularly a compound of the formula (7)

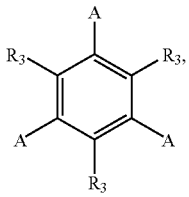

in which

A is a radical of the formula (7a)

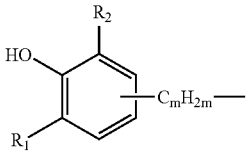

$R_1$, $R_2$ and $R_3$ independently of one another are $C_1$-$C_5$ alkyl; and m is 1 to 3.

Component ($a_1$) is preferably also a compound of the formula (8)

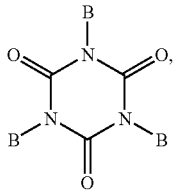

in which

B is a radical of the formula (8a)
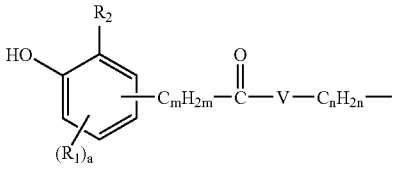
$R_1$ and $R_2$ independently of one another are $C_1$-$C_5$ alkyl;
V is —O—; or —NH—;
a is 1; or 2;
m is 1 to 3; and
n is 0 to 3.
Typical antioxidants used according to the invention are listed in Table 1:
TABLE 1
| Compound of the formula | |
|---|---|
| (9) | 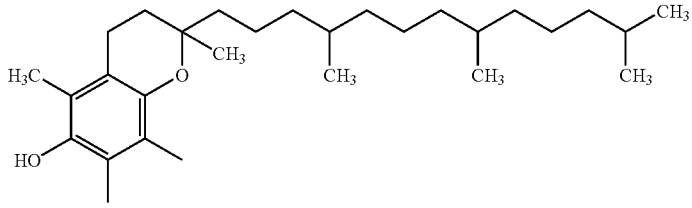 |
| (10) | 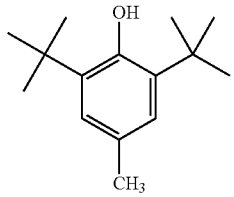 |
| (11) | 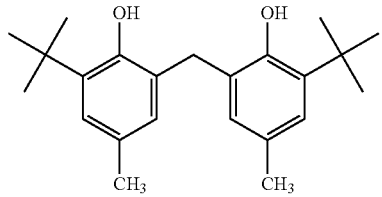 |
| (12) | 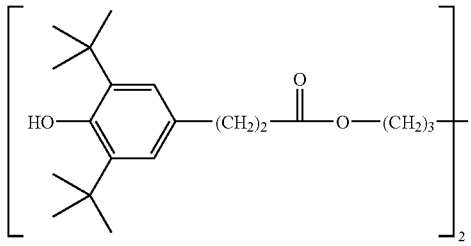 |
| (13) | 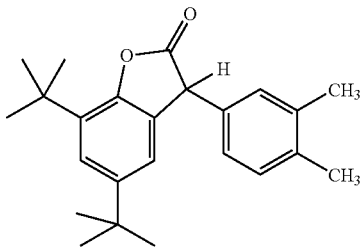 |

TABLE 1-continued
| Compound of the formula | |
|---|---|
| (14) | 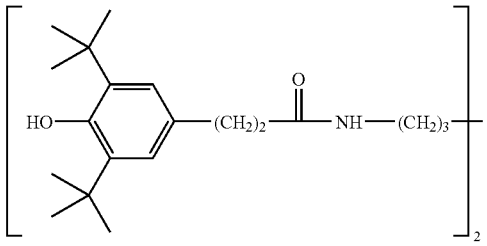 |
| (15) | 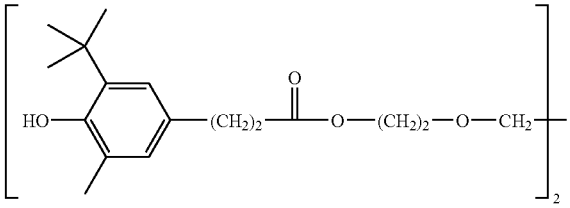 |
| (16) | 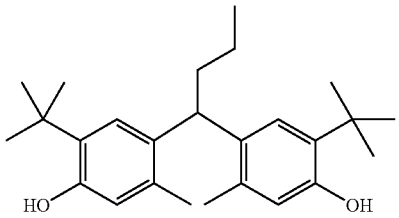 |
| (17) | 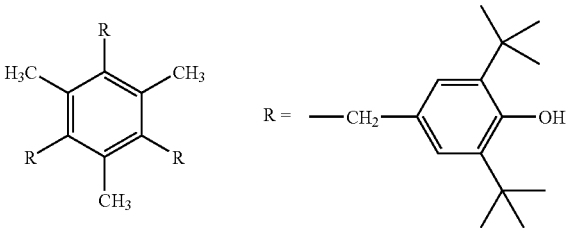 |
| (18) | 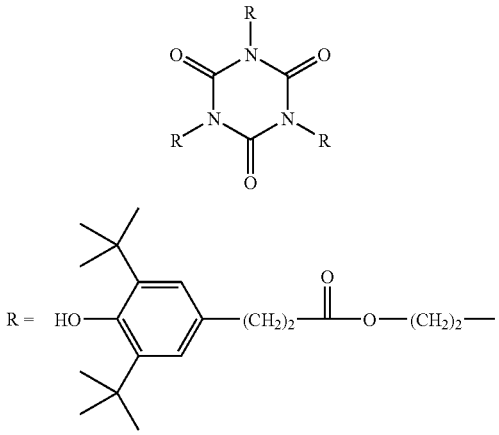 |

TABLE 1-continued
| Compound of the formula | |
|---|---|
| (19) | 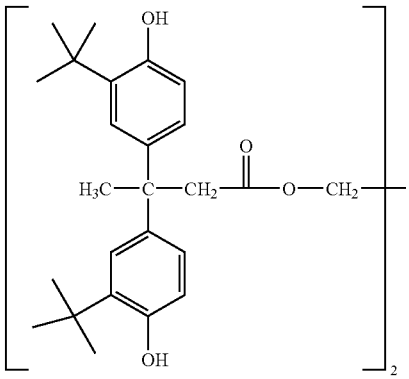 |
| (20) | 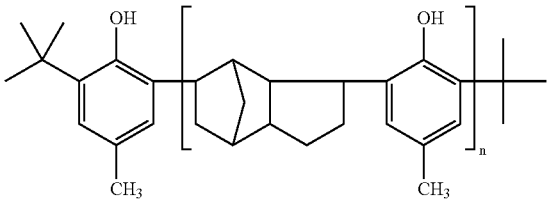 |
| (21) | 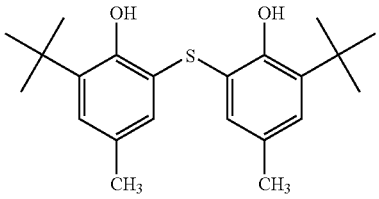 |
| (22) | 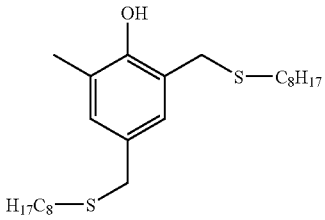 |
| (23) | 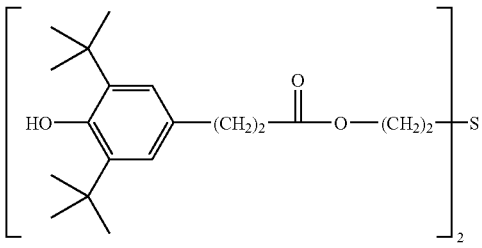 |

TABLE 1-continued
| Compound of the formula | |
|---|---|
| (24) | 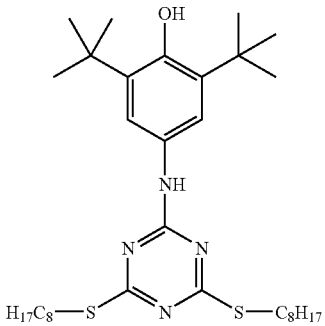 |
| (25) | 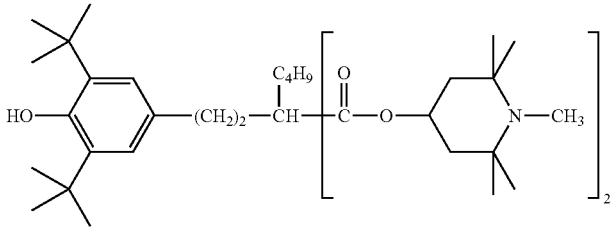 |
| (26) | 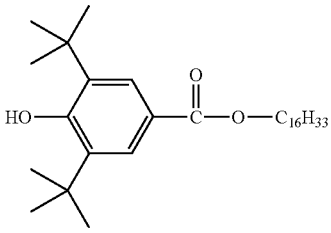 |
| (27) | 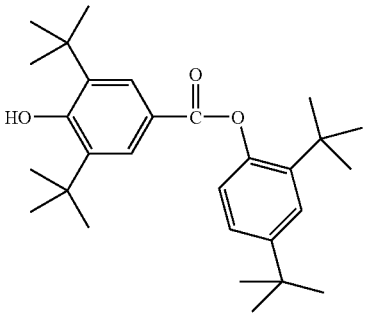 |
| (28) | 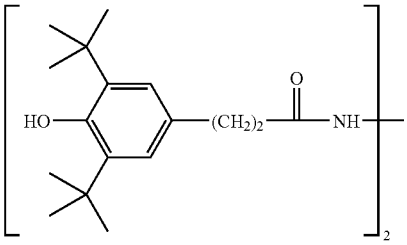 |

TABLE 1-continued
| Compound of the formula | |
|---|---|
| (29) | 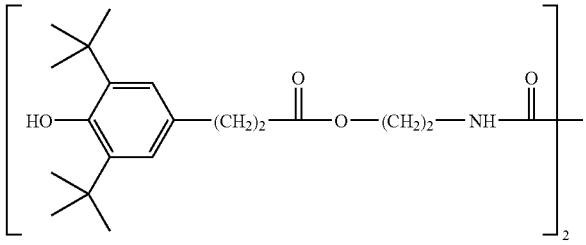 |
| (30) | 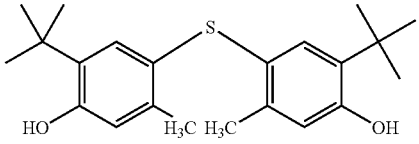 |
| (31) | 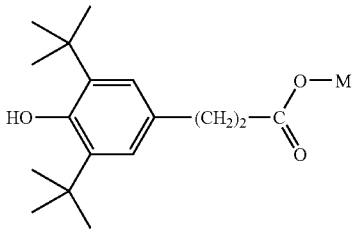 M = H, ammonium, alkali metal |
| (32) | 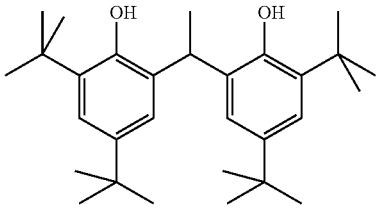 |
| (33) | 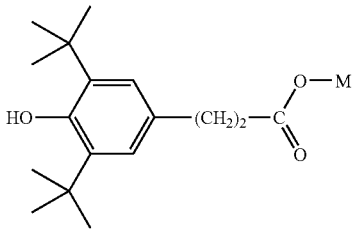 M = H, ammonium, alkali metal |
| (34) | 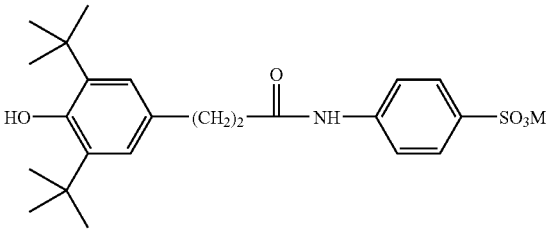 M = H, Na |

The antioxidants corresponding to component ($a_1$) and ($a_2$) can be used in the novel cleaning composition either as individual components or as a mixture of several individual compounds.

Component (a) is generally present in the novel cleaning composition in a concentration of from 50 to 1000 ppm.

The antioxidants used according to the invention have excellent reactivity and can thus be used advantageously at low temperatures. Furthermore, they display better stability to hydrolysis, particularly in an alkaline medium. Because of their good solubility, they can be easily incorporated into soap formulations.

The novel compositions thus show high stability towards colour changes and chemical decomposition. This is to be attributed to the effectiveness, colour stability, ease of incorporation and stability to hydrolysis of the antioxidants used.

Component (b) in the novel cleaning composition may be any surfactant which removes dirt from the skin and is at the same time sensitive to the oxidative degradation which leads to decoloration and/or unpleasant odours.

Suitable examples are anionic, nonionic or zwitterionic and amphoteric synthetic, detersive substances.

Suitable anionic detersive substances are sulfates, such as, for example, fatty alcohol sulfates whose alkyl chain has from 8 to 18 carbon atoms, such as, for example, sulfated lauryl alcohol;

fatty alcohol ether sulfates, such as, for example, the acid esters or salts thereof of a polyadduct of from 2 to 30 mol of ethylene oxide with 1 mol of a $C_8$-$C_{22}$ fatty alcohol;

the alkali metal salts, ammonium salts or amine salts of $C_8$-$C_{20}$-fatty acids referred to as soaps, such as, for example, coconut fatty acid;

alkylamidosulfates;

alkylaminosulfates, such as, for example, monoethanolamine lauryl sulfate;

alkylamide ether sulfates;

alkylaryl polyether sulfates;

monoglyceride sulfates;

alkanesulfonates whose alkyl chain contains from 8 to 20 carbon atoms, for example dodecylsulfonate;

alkylamidosulfonates;

alkylarylsulfonates;

α-olefinsulfonates;

sulfosuccinic acid derivatives, such as, for example, alkylsulfosuccinates, alkyl ether sulfosuccinates or alkylsulfosuccinamide derivatives;

N-(alkylamidoalkyl)amino acids of the formula

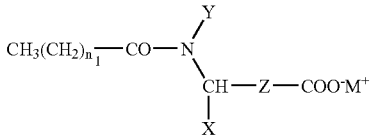

(35)

in which

X is hydrogen; $C_1$-$C_4$ alkyl or —$COOM^+$;

Y is hydrogen or $C_1$-$C_4$ alkyl;

Z is —$(CH_2)_{m1-1}$ $m_1$ is an integer from 1 to 5;

$n_1$ is an integer from 6 to 18 and

M is an alkali metal cation or ammonium cation;

alkyl and alkylaryl ether carboxylates of the formula $$CH_3—X—Y-A \quad (34)$$

in which

X is a radical —$(CH_2)_{5-19}$—O—;

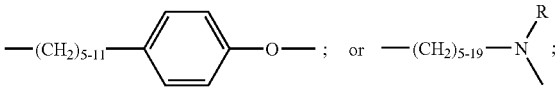

R is hydrogen; or $C_1$-$C_4$ alkyl;

Y is —$(CHCHO)_{1-50}$—;

A is —$(CH_2)_{m2-1}COO^-M^+$; or

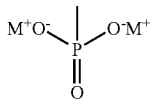

$m_2$ is from 1 to 6 and

M is an alkali metal cation or amine cation.

Other anionic surfactants used are fatty acid methyl taurides, alkylisethionates, fatty acid polypeptide condensates and fatty alcohol phosphoric esters. The alkyl radicals in these compounds preferably have from 8 to 24 carbon atoms.

The anionic surfactants are generally in the form of their water-soluble salts, such as the alkali metal salts, ammonium salts or amine salts. Examples of such salts are lithium, sodium, potassium, ammonium, triethylamine, ethanolamine, diethanolamine or triethanolamine salts. In particular, the sodium, potassium or ammonium ($NR_1R_2R_3$) salts are used, in which $R_1$, $R_2$ and $R_3$ independently of one another are hydrogen, $C_1$-$C_4$ alkyl or $C_1$-$C_4$ hydroxyalkyl.

Very particularly preferred anionic surfactants in the novel composition are monoethanolamine lauryl sulfate or the alkali metal salts of fatty alcohol sulfates, in particular sodium lauryl sulfate and the product of the reaction between from 2 to 4 mol of ethylene oxide and sodium lauryl ether sulfate.

Suitable zwitterionic and amphoteric surfactants are $C_8$-$C_{18}$ betaines, $C_8$-$C_{18}$ sulfobetaines, $C_8$-$C_{24}$ alkylamido-$C_1$-$C_4$ alkylenebetaines, imidazoline carboxylates, alkylamphocarboxy-carboxylic acids, alkylamphocarboxylic acids (e.g. lauroamphoglycinate) and N-alkyl-b-aminopropionates or -iminodipropionates, the $C_{10}$-$C_{20}$ alkylamido-$C_1$-$C_4$ alkylenebetaines and, in particular, coconut fatty acid amidopropylbetaine being preferred.

Examples of suitable nonionogenic surfactants are derivatives of the adducts of propylene oxide/ethylene oxide having a molecular weight of from 1000 to 15,000, fatty alcohol ethoxylates (1-50 EO), alkylphenol polyglycol ethers (1-50 EO), ethoxylated carbohydrates, fatty acid glycol partial esters, such as, for example, diethylene glycol monostearate, fatty acid alkanolamides and dialkanolamides, fatty acid alkanolamide ethoxylates and fatty amine oxides.

Furthermore, component (b) may be the salts of saturated and unsaturated $C_8$-$C_{22}$ fatty acids either alone, as a mixture with one another or as a mixture with the other detersive substances mentioned as component (b). Examples of these fatty acids are capric, lauric, myristic, palmitic, stearic, arachidic, behenic, caproleic, dodecenoic, tetradecenoic, octadecenoic, oleic, eicosenoic and erucic acid, and the technical-grade mixtures of such acids, such as, for example, coconut fatty acid. These acids are in the form of salts, suitable cations being alkali metal cations, such as sodium and potassium cations, metal atoms, such as zinc and aluminium atoms, or sufficiently alkaline, nitrogen-containing organic compounds, such as amines or ethoxylated amines. These salts can also be prepared in situ.

Component (b) in the novel composition is preferably a soap, i.e. a branched or unbranched long-chain alkyl- or alkenyl-carboxylic acid salt, such as, for example, the sodium, potassium, ammonium or substituted ammonium salt.

Furthermore, in addition to components (a) and (b), the novel composition may comprise, as component (c), a light protection agent of the sterically hindered amine type.

This is preferably a 2,2,6,6-tetraalkylpiperidine derivative which contains at least one group of the formula (36)

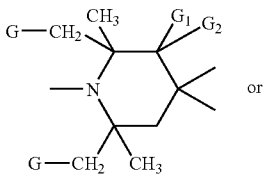

or (37)

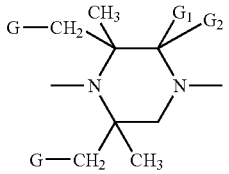

in which G is hydrogen or methyl, in particular hydrogen.

Examples of tetraalkylpiperidine derivatives which can be used as component (c) can be found in EP-A-356 677, pages 3-17, sections a) to f). Said passages of this patent are regarded as part of the present description. The following tetraalkylpiperidine derivatives are particularly advantageously used:

bis(2,2,6,6-tetramethylpiperidin-4-yl) sebacate, bis(2,2,6,6-tetramethylpiperidin-4-yl) succinate, bis(1,2,2,6,6-pentamethylpiperidin-4-yl) sebacate, bis(1-octyloxy-2,2,6,6-tetramethylpiperidin-4-yl) sebacate, bis(1,2,2,6,6-pentamethylpiperidyl) n-butyl 3,5-di-tert-butyl-4-hydroxybenzylmalonate, the condensate of 1-hydroxyethyl-2,2,6,6-tetramethyl-4-hydroxypiperidine and succinic acid, the condensate of N,N'-bis(2,2,6,6-tetramethyl-4-piperidyl) hexamethylenediamine and 4-tert-octylamino-2,6-dichloro-1,3,5-s-triazine, tris(2,2,6,6-tetramethyl-4-piperidyl) nitrilotriacetate, tetrakis(2,2,6,6-tetramethyl-4-piperidyl) 1,2,3,4-butanetetraoate, 1,1'-(1,2-ethanediyl)bis(3,3,5,5-tetramethylpiperazinone), 4-benzoyl-2,2,6,6-tetramethylpiperidine, 4-stearyloxy-2,2,6,6-tetramethylpiperidine, bis(1,2,2,6,6-pentamethylpiperidyl)-2-n-butyl-2-(2-hydroxy-3,5-di-tert-butylbenzyl) malonate, 3-n-octyl-7,7,9,9-tetramethyl-1,3,8-triazaspiro[4.5]decan-2,4-dione, bis(1-octyloxy-2,2,6,6-tetramethylpiperidyl) sebacate, bis(1-octyloxy-2,2,6,6-tetramethylpiperidyl) succinate, the condensate of N,N-bis(2,2,6,6-tetramethyl-4-piperidyl)-hexamethylenediamine and 4-morpholino-2,6-dichloro-1,3,5-triazine, the condensate of 2-chloro-4,6-di(4-n-butylamino-2,2,6,6-tetramethylpiperidyl)-1,3,5-triazine and 1,2-bis(3-aminopropylamino)ethane, the condensate of 2-chloro-4,6-di(4-n-butylamino-1,2,2,6,6-pentamethylpiperidyl)-1,3,5-triazine and 1,2-bis(3-aminopropylamino)ethane, 8-acetyl-3-dodecyl-7,7,9,9-tetramethyl-1,3,8-triazaspiro[4.5]decan-2,4-dione, 3-dodecyl-1-(2,2,6,6-tetramethyl-4-piperidyl) pyrrolidine-2,5-dione, 3-dodecyl-1-(1,2,2,6,6-pentamethyl-4-piperidyl)pyrrolidine-2,5-dione, a mixture of 4-hexadecyloxy- and 4-stearyloxy-2,2,6,6-tetramethylpiperidine, the condensate of N,N'-bis-(2,2,6,6-tetramethyl-4-piperidyl)hexamethylenediamine and 4-cyclohexylamino-2,6-dichloro-1,3,5-triazine, the condensate of 1,2-bis(3-aminopropylamino)ethane and 2,4,6-trichloro-1,3,5-triazine and 4-butylamino-2,2,6,6-tetramethylpiperidine (CAS Reg. No. [136504-96-6]); (2,2,6,6-tetramethyl-4-piperidyl)-n-dodecylsuccinimide, (1,2,2,6,6-pentamethyl-4-piperidyl)-n-dodecylsuccinimide, 2-undecyl-7,7,9,9-tetramethyl-1-oxa-3,8-diaza-4-oxospiro[4.5]decane, the product of the reaction between 7,7,9,9-tetramethyl-2-cycloundecyl-1-oxa-3,8-diaza-4-oxospiro[4.5]decane and epichlorohydrin, tetra(2,2,6,6-tetramethylpiperidin-4-yl)butane 1,2,3,4-tetracarboxylate, tetra(1,2,2,6,6-pentamethylpiperidin-4-yl)butane 1,2,3,4-tetracarboxylate, 2,2,4,4-tetramethyl-7-oxa-3,20-diaza-21-oxodispiro[5.1.11.2]heneicosane, 8-acetyl-3-dodecyl-1,3,8-triaza-7,7,9,9-tetramethylspiro[4.5]decane-2,4-dione, or a compound of the formulae (38)

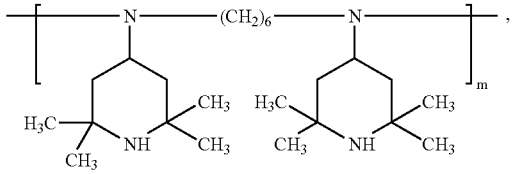

in which m has a value from 5-50, (39)

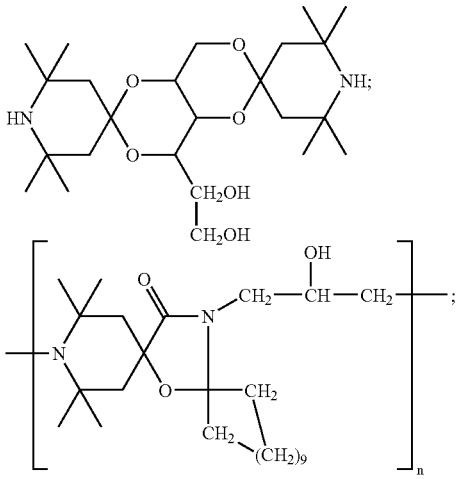

(40)

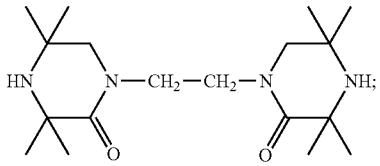

(41)

-continued (42)

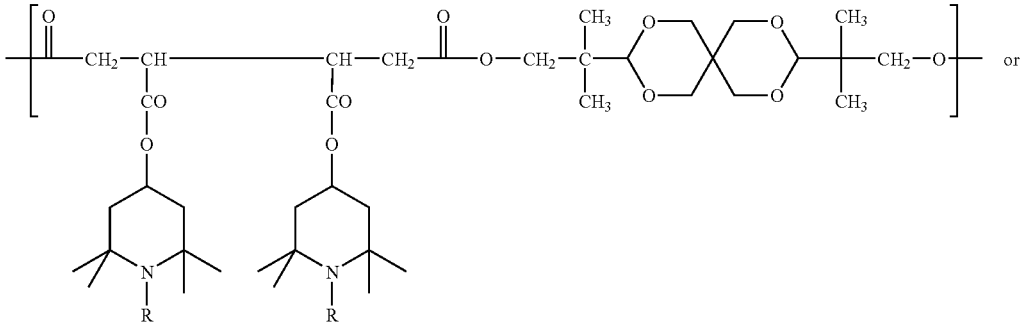

R = H or $CH_3$ (43)

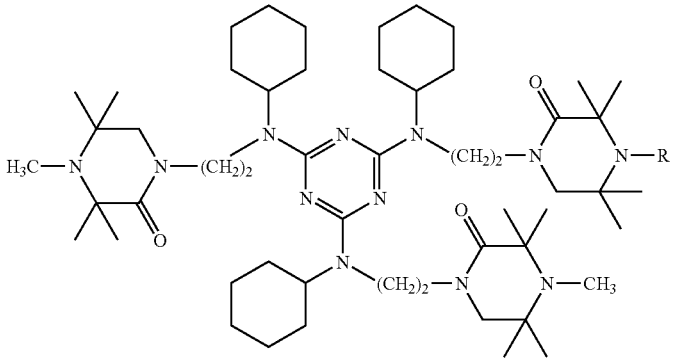

R = H or $CH_3$

The novel composition can be in the form of a solid, gel, syndet or liquid soap. It can be prepared by the usual methods.

The soaps (solid soaps, syndets, liquid soaps) are prepared by processes which are generally customary in the soaps industry for these products and described in the literature (see, for example, L. Spitz (Ed.), Soaps and Detergents, A Theoretical and Practical Review, AOCS Press, Champaign, Ill., USA (1996)). An important factor in the preparation of solid soaps is the intensive mixing of the soap composition prior to extrusion to achieve a homogeneous distribution of the ingredients, in particular of the antioxidant. The antioxidant is usually added to the soap composition directly or, if appropriate, predissolved in perfume, homogeneously distributed therein by mixing (for example in a guide-beam mixer) and kneading (for example in an intensive kneader), before the composition is extruded or moulded. Liquid soaps are likewise produced by homogenization of the constituents in suitable mixing devices (for example Sulzer mixers, Erestat mixers or DAT mixers from Pfaudler), uniform distribution of the antioxidant generally being achieved more quickly than in the case of solid soaps as a result of the lower viscosity of the formulation. An alternative procedure involves incorporating the antioxidant into the basic soap composition (flakes, ribbons), if necessary with the application of heat (melting).

The following examples illustrate the invention.

Unless stated otherwise, parts and percentages are by weight. The temperature is given in ° C.

PREPARATION EXAMPLES FOR SOAP COMPOSITIONS

Example 1

Preparation of a Solid Soap

| | Component | % by weight |
|---|---|---|
| A | Mixture of tallow fatty, coconut and palm kernel soaps (sodium salts) | 85 |
| B | Water | ad 100 |
| C | Glycerol | 1 |
| | Titanium dioxide | 0.2 |
| | Lactic acid (88%) | 0.2 |
| | Antioxidant of the formula (14), (15), (17), (21), (22), (23), (25) or (28) | 0.005-0.1 |
| | Disodium EDTA | 0.1 |

Preparation: the soap base (A) is thoroughly mixed, and the water (B) is added at 20° C. The viscous paste is homogenized using a rotor-stator, and then the components (C) are added in the order given with vigorous mixing. The mixture is homogenized for a further 15 minutes and extruded in a bench extruder. The soap bars are produced by pressing (bench press).

Example 2

Preparation of a Liquid Soap

| Component | % by weight |
|---|---|
| Glycerol monostearate (40%) | 5.0 |
| Ammonium lauryl sulfate (28%) | 25.0 |
| Cocoamidopropylhydroxysultaine | 3.5 |
| Disodium EDTA | 0.1 |
| Propylene glycol | 1.0' |
| Lauryl diethanolamide | 0.5 |
| Antioxidant of the formula (14), (15), (17), (21), (22), (23), (25) or (28) | 0.001-0.05 |
| Fragrances, preservatives | Q.S. |
| Water | ad 100 |
| Citric acid | Q.S. (pH 5.5-6.5) |

Preparation: The ingredients are initially introduced in the order given and mixed with water. The pH is adjusted to 5.5-6.5 using citric acid. The mixture is then homogenized for 10 minutes at 20° C. and the resulting liquid soap is poured into bottles.

Example 3

Preparation of a Syndet Soap

| | Component | % by weight |
|---|---|---|
| A | Sodium cocoylisethionate | 20 |
| | Sodium lauryl sulfoacetate | 16 |
| | Paraffin | 19 |
| | Wax, microcrystalline | 1 |
| B | Water | ad 100 |
| C | Antioxidant of the formula (14), (15), (17), (21), (22), (23), (25) or (28) | 0.002-0.05 |
| | Maize starch | 8 |
| | Coconut fatty acid | 2 |
| | Lauryl diethanolamide | 2 |
| | Dextrin | 21 |
| | Lactic acid (88%) | 1 |

Preparation: the soap base (A) is thoroughly mixed, and water (B) is added at 20° C. The paste is homogenized using a rotor-stator, and then components (C) are added in the order given with vigorous mixing. The mixture is homogenized for a further 15 minutes and extruded in a bench extruder. The soap bars are produced by pressing (bench press).

Application Examples

Example 4

Test as Regards Discoloration in Soaps in an Oxidative Environment

Antioxidants tested: compounds of the formulae (11), (15), (16), (25), (32) and (33).

500 ppm of the respective antioxidant to be tested are, together with 500 ppm of benzoyl peroxide and 0.2% of titanium dioxide, homogeneously distributed in a customary soap base (mixture of tallow fat, coconut and palm kernel soaps) by vigorous mixing and kneading in a bench mixer. The mixing process is repeated several times to ensure homogeneous distribution of the antioxidant in the soap.

The mixture is extruded using a bench extruder, producing test soap bars weighing approximately 1 g. These soaps are stored in a drying cabinet at 40° C. for two months, individual test soap bars being checked for their discoloration after each week. This is carried out by quantitative colorimetry, the reflectance spectroscopic method advantageously being used. This method is described in detail in the literature (see, for example, Colorimetry, Second Edition, International Commission on Illumination (CIE), CIE publication 15.2 (1986)). Comparison of the colorimetric results of the test preparations with those of the standard (freshly prepared sample having the same composition) is a measure of the colour stability of the antioxidant used.

It is found that a good colour stability is achieved with the antioxidants tested.

Example 5

Test as Regards Solubility in Soaps

Antioxidants tested: compounds of the formulae (11), (15), (16), (21), (23), (24), (32) and (33).

To determine the solubility, 0.1% of each of the antioxidants is thoroughly mixed into a customary soap base (mixture of tallow fat, coconut and palm kernel soaps) at 40° C. The mixture is then cooled to room temperature and a light microscope is used to check whether the antioxidant is homogeneously distributed in the soap composition (absence of crystals, no mixed phases).

The results of these experiments show that the compounds tested have very good solubility and can be incorporated quickly and completely.

Example 6

Test as Regards Stability to Hydrolysis

Antioxidants tested: compounds of the formulae (11), (14), (15), (16), (17), (21), (22), (24), (28), (32) and (33).

The stability of antioxidants in alkali can be tested quickly using a simple test. For this purpose, 0.05% of each of the antioxidants is mixed, in a bench mixer, into conventional soap flakes which customarily contain 10-15% of moisture and 0.02-0.1% of free alkali (as $Na_2O$) (overall values, % by weight). The mixing process should be repeated several times to ensure homogeneous distribution of the antioxidant in the soap. The samples are stored for 2 months in a drying cabinet at 40° C., and then the relative content of unchanged antioxidant is determined using HPLC analysis. The reference used (100% values) is the HPLC signals (heights or areas) of the respective antioxidants in freshly prepared soap formulations.

Results:

The antioxidants tested have good stability in soap formulations. Their content in alkaline soaps, as determined by HPLC, is virtually unchanged after storage for 2 months in accordance with the above test.

The novel compositions (soaps) thus have good stability to colour changes and chemical decomposition.

What is claimed:

1. A method of stabilizing a surfactant comprising a long alkyl or alkenyl chain, comprising adding thereto an effective stabilizing amount of ($a_2$) an antioxidant of the formula (3)

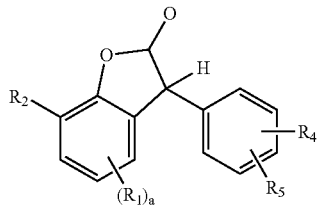

in which in the formulae (3)

$R_1$ is hydrogen; $C_1$-$C_{22}$ alkyl; $C_1$-$C_{22}$ alkylthio; $C_5$-$C_{12}$ cycloalkyl; phenyl; or $C_7$-$C_9$ phenylalkyl;

$R_2$ is $C_1$-$C_{22}$ alkyl; $C_5$-$C_{12}$ cycloalkyl; phenyl; $C_7$-$C_9$ phenylalkyl; or —$SO_3M$;

a is 0; 1; or 2;

M is hydrogen; alkali metal; or ammonium; and $R_4$ and $R_5$ independently of one another are hydrogen; or $C_1$-$C_{22}$alkyl wherein the component ($a_2$) is present in a concentration of from 50 to 1000 ppm based on weight of the surfactant.

2. A method according to claim 1, wherein $R_1$ and $R_2$ independently of one another are $C_1$-$C_{22}$ alkyl.

3. A method according to claim 2, wherein $R_1$ and $R_2$ independently of one another are $C_1$-$C_5$ alkyl.

4. A method according to claim 1, wherein a is 1.

5. A method according to claim 1, wherein the surfactant comprising a long alkyl or alkenyl chain is an anionic, nonionic or zwitterionic and amphoteric synthetic, detersive substance.

6. A method according to claim 1, wherein the mixture is in the form of a solid, gel, syndet or liquid formulation.

7. A method according to claim 1, further comprising component (c) in which component (c) is a light protection agent of the sterically hindered amine type.

8. A method according to claim 7, in which component (c) is a 2,2,6,6-tetraalkylpiperidine derivative which contains at least one group of the formula (36)

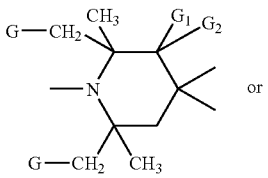

or (37)

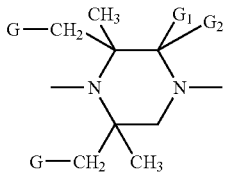

in which

G is hydrogen or methyl.

9. A method according to claim 1 further comprising at least one antioxidant selected from the group consisting of component ($a_1$) formula (1) and component ($a_1$) formula (2) wherein ($a_1$) a phenolic antioxidant of the formula (1)

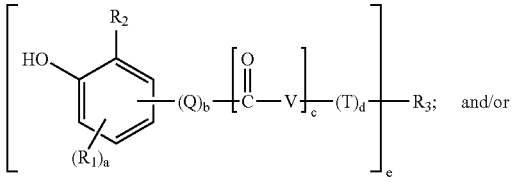

and/or

-continued (2)

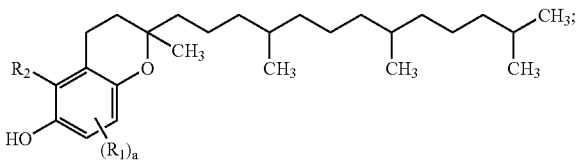

in which in the formulae (1) and (2)

$R_1$ is hydrogen; $C_1$-$C_{22}$ alkyl; $C_1$-$C_{22}$ alkylthio; $C_5$-$C_{12}$ cycloalkyl; phenyl; or $C_7$-$C_9$ phenylalkyl;

$R_2$ is $C_1$-$C_{22}$ alkyl; $C_5$-$C_{12}$ cycloalkyl; phenyl; $C_7$-$C_9$ phenylalkyl; or —$SO_3M$;

Q is —$C_mH_{2m}$—;

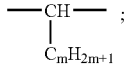

—$C_mH_{2m}$—NH; a radical of the formula (1a)

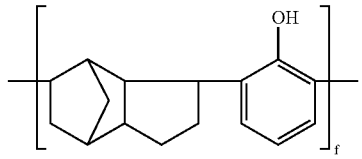

; or (1b)

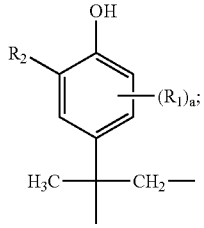

T is —$C_nH_{2n}$—; —$(CH_2)_n$—O—$CH_2$—;

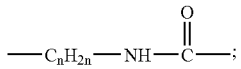

or a radical of the formula (1c)

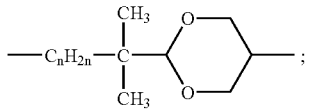

V is —O—; or —NH—;

a is 0; 1; or 2;

b, c and d independently of one another are 0; or 1;

e and f independently of one another are an integer from 1 to 3; and m, n and p independently of one another are an integer from 1 to 3;

when e is 1, $R_3$ is hydrogen; M; $C_1$-$C_{22}$ alkyl; $C_5$-$C_{12}$ cycloalkyl; $C_1$-$C_{22}$ alkylthio; $C_2$-$C_{22}$ alkenyl; $C_1$-$C_{18}$ phenylalkyl; a radical of the formula (1d)

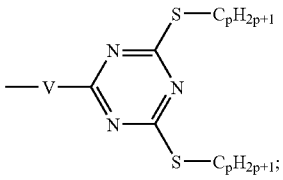

(1e)

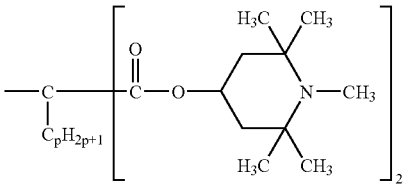

; or (1f)

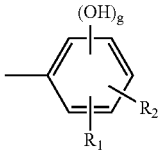

where, when $R_3$ is $C_1$-$C_{22}$ alkyl, b=0; or Q is a radical of the formula (1a) or (1b);

g is 0 or 1;

M is hydrogen; alkali metal; or ammonium;

when e is 2, $R_3$ is a direct bond; —$CH_2$—;

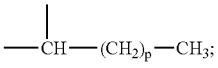

—O—; or —S—;

when e is 3, $R_3$ is a radical of the formula (1g)

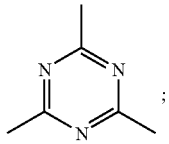

;

(1h)

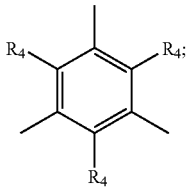

(1i)

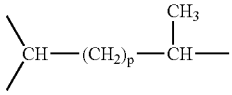

; or (1k)

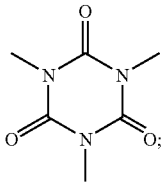

where, when $R_3$ is a radical of the formula (1k), c=1; and $R_4$ is hydrogen; or $C_1$-$C_{22}$alkyl with the proviso that the phenolic antioxidant of formula ($a_1$)(1) is not 4-methyl-2,6-di-t-butylphenol.

10. A method according to claim 9, wherein the antioxidants corresponding to the component ($a_1$) and ($a_2$) are used as an individual compound or a mixture of several individual compounds.

11. A method according to claim 9, wherein the total of components ($a_1$) and ($a_2$) is present in a concentration of from 50 to 1000 ppm based on weight relative to the surfactant.

* * * * *